US007222705B1

(12) United States Patent
Guza

(10) Patent No.: US 7,222,705 B1
(45) Date of Patent: May 29, 2007

(54) FLOOR SHIELD CARRYING BAG ACCESSORY

(76) Inventor: David E. Guza, 5531 Corey Swirl Dr., Dublin, OH (US) 43017

( * ) Notice: Subject to any disclaimer, the term of this patent is extended or adjusted under 35 U.S.C. 154(b) by 52 days.

(21) Appl. No.: 10/809,228

(22) Filed: Mar. 25, 2004

Related U.S. Application Data

(60) Provisional application No. 60/457,526, filed on Mar. 25, 2003.

(51) Int. Cl.
*A45C 9/00* (2006.01)

(52) U.S. Cl. ..... 190/1; 190/2; 224/577; 383/4

(58) Field of Classification Search ..... 190/1, 190/2; 383/4; 5/417; 224/155, 156, 577
See application file for complete search history.

(56) References Cited

U.S. PATENT DOCUMENTS

| | | | | | |
|---|---|---|---|---|---|
| 772,966 | A | * | 10/1904 | Shade et al. | 190/2 |
| 1,951,527 | A | * | 3/1934 | Oas | 190/109 |
| 2,540,165 | A | * | 2/1951 | Fiel | 190/111 |
| 2,857,957 | A | * | 10/1958 | Gay | 297/114 |
| 2,865,433 | A | * | 12/1958 | Warner | 383/25 |
| 3,045,261 | A | * | 7/1962 | Hocherman | 5/413 R |
| 3,143,748 | A | * | 8/1964 | Manning | 5/420 |
| 3,253,293 | A | | 5/1966 | George et al. | |
| 3,763,972 | A | * | 10/1973 | Karzmar | 190/8 |
| 4,466,517 | A | * | 8/1984 | Spiegelman | 190/8 |
| 4,566,130 | A | * | 1/1986 | Coates | 383/15 |
| D287,667 | S | * | 1/1987 | Cathcart et al. | D3/274 |
| 4,736,825 | A | * | 4/1988 | Belfi | 190/8 |
| 4,863,003 | A | * | 9/1989 | Carter | 190/8 |
| 5,199,120 | A | * | 4/1993 | Holmes | 5/419 |
| 5,573,288 | A | * | 11/1996 | Raffensperger | 297/188.12 |
| D378,953 | S | * | 4/1997 | Pavlik | D3/233 |
| 5,649,658 | A | * | 7/1997 | Hoffman et al. | 224/576 |
| 5,819,999 | A | * | 10/1998 | Tennant | 224/155 |
| 6,082,816 | A | * | 7/2000 | Gottlieb et al. | 297/188.1 |
| 6,200,661 | B1 | | 3/2001 | Daniels et al. | |
| 6,547,110 | B2 | * | 4/2003 | O'Hare | 224/155 |
| D474,934 | S | * | 5/2003 | Ildstad et al. | D6/601 |

(Continued)

FOREIGN PATENT DOCUMENTS

EP 1321065 A1 * 6/2003

(Continued)

*Primary Examiner*—Sue A. Weaver
(74) *Attorney, Agent, or Firm*—Standley Law Group LLP; James L. Kwak; Stephen L. Grant

(57) ABSTRACT

A carrying bag accessory featuring a mat that is externally affixed to a bag or any variant bag designs such as a gym bag, duffle bag, rucksack, backpack, etc., and conveniently stored in a folded configuration when not in use and deployed in an unfolded configuration adjacent to the bag when in use to provide a flat clean surface upon which a user can rest or place items on. The mat is comprised of a multiplicity of rigid or semi-rigid hinged panels carefully configured to fold in such a manner as to preserve the cleanliness of surfaces that come into contact with the user. The mat is retained in a folded configuration by means of magnetic or other types of fasteners allowing the deployment and storage of the mat by the user with minimal contact and effort.

20 Claims, 6 Drawing Sheets

U.S. PATENT DOCUMENTS

| | | | | |
|---|---|---|---|---|
| 6,848,746 | B2 * | 2/2005 | Gentry | 297/380 |
| 2002/0074251 | A1 | 6/2002 | Hirshberg | |
| 2004/0069583 | A1 * | 4/2004 | Tamura | 190/18 A |

FOREIGN PATENT DOCUMENTS

| | | | |
|---|---|---|---|
| FR | 2666493 | A1 * | 3/1992 |
| GB | 2061712 | A * | 5/1981 |

* cited by examiner

FLOOR SHIELD CARRYING BAG ACCESSORY

This application claims the benefit of U.S. Provisional Application No. 60/457,526 filed on Mar. 25, 2003.

BACKGROUND AND SUMMARY OF THE INVENTION

The present invention relates to the filed of portable protective sanitary shields. More particularly, the present invention relates to portable floor mats. Exposure to a variety of viruses and fungi that cause foot infections, such as athlete's foot and plantar warts among other diseases, is common in locker rooms. The principal problem lies with the difficulty of maintaining a dry and disinfected locker room floor surface. Many locker room floor layouts conveniently place the showers and bathroom facilities in close proximity to patron's storage lockers. Consequently, locker room floors are typically wet which subsequently become soiled with foot traffic becoming a vector for the transmission of disease. To protect themselves from disease and soiling their clothes, people have bene observed standing on towels, shoes, soiled clothing, and elevated seating benches to avoid contact with a contaminated and soiled locker room floor while changing clothes. Although perforated drainage floor coverings have been implemented to reduce the possibility of slipping accidents caused by standing water, these coverings still become contaminated with fungi, viruses, and soil that can be spread to others. Therefore, there exists a need for a method by which to provide a user with a reusable, easily deployable, portable, sanitary protective floor mat that prevents exposure of the user to floor contamination while minimizing the possibility of self-contamination of its user-exposed surfaces during use. A common item taken to locker rooms is a carrying bag that is used to carry a variety of items, such as clothes, sporting equipment, etc. Such a bag can be effectively employed as a convenient vehicle upon which to integrate and carry a sanitary floor shield mat. The present invention is an attachment to or a modification of a carrying bag, which provides a protective floor shield mat used to protect users from exposure to contamination from various sources and surfaces. More particularly from contamination found in such places as locker rooms.

DESCRIPTION OF THE PRIOR ART

The general concept of providing a barrier to isolate a user from contamination is well known in the prior art. However, none of the methods known in the prior art provide for a method of providing a contamination barrier externally attachable to a carrying bag that is not subject to the cross-contamination of clean surfaces during use or is easily deployed with minimal user intervention. George, et.al. (U.S. Pat. No. 3,253,293) teaches a method of providing a clean surface upon which to stand in a bathroom environment but is not configurable to a sports bag. Hirshberg (Patent Application 20020074251) teaches the use of a sports bag incorporating an internally stored flexible mat that can be manually rolled-up and stored within a compartment internal to a sports bag, but this method requires the user to manually remove and deploy the mat from an internal bag compartment, which exposes the user to contaminated surfaces and the bag to cross-contamination. Furthermore, the process of rolling a flexible mat upon itself allows intimate contact between its clean upper surface and its lower surface that is contaminated through contact with a floor. After its first use, redeployment of the mat exposes the user to undesirable contaminated surfaces. The disadvantages of this method are:

a) Cross-contamination of clean and soiled surfaces, b) Exposure of the user to contaminated surfaces while manually deploying the mat, and c) Consumption of usable internal space within the sports bag.

Consequently, there is a need for a method of providing a contamination barrier externally attachable to a carrying bag that is not subject to the cross-contamination of its clean surfaces during use and which is easily deployed with minimal user intervention.

SUMMARY OF THE INVENTION

Since locker room floors are difficult to sanitize and keep dry, this invention describes methods of preventing foot and clothing contact with wet and/or contaminated floor surfaces. Envisioned as an accessory integrated into a common carrying bag, one embodiment of this invention isolates the user from the floor by means of a conveniently deployable barrier sheet(s) or panel(s) that can be externally affixed either removably or permanently to the external surface of a sports bag with the attachment to the bottom exterior surface of the carrying bag as the preferred embodiment. These rigid or semi-rigid hinged panels can be deployed in a fully extended configuration when in use to provide a sanitary surface upon which a user can stand or upon which a user can rest articles. The barrier floor shield can be folded up and stowed externally within the footprint of the carrying bag in a compact manner through a procedure described herein, minimizing exposure of the user to contamination. The preferred embodiment to retain the hinged panel barrier in a folded configuration is by the means of magnetic latches. However, the use of a wide variety of available fasteners, such as male and female mating hook and loop fasteners, clips, snaps, etc. can be conceivably employed within the spirit of this invention by one skilled in the art. In the context of this invention, a "carrying bag" is defined as a bag used to carry clothing, sports or other equipment, etc., or any variant bag designs such as a gym bag, duffle bag, rucksack, backpack, suitcase, travel bag, etc., or other containers used to carry such items.

It is an object of the present invention to provide a storable protective mat that can be externally attached to a carrying bag, which can be deployed and extended adjacent to the carrying bag when in use and stowed beneath the carrying bag when not in use, thus preserving valuable internal carrying bag storage space, as well as providing a protective barrier for the carrying bag itself when in contact with contaminated and/or wet surfaces.

It is a further object of the present invention to provide a means to magnetically latch and retain the storable protective mat in a folded configuration for storage, with the magnetic latches providing a reusable, long-lived method of allowing multiple mat deployment and stowage cycles which minimizes wear and fatigue of the latching system.

It is a further object of the present invention to provide an accessible tab feature on the mat to allow the user to easily deploy and stow the mat, preferably with the use of one hand and one foot.

It is a further object of the present invention to provide a novel means of preserving clean mat surfaces for presentation to the user by means of a special panel folding configuration method employing a reverse panel-hinging scheme.

It is a further object of the present invention to provide a means of optionally removing the mat accessory from the carrying bag for cleaning, segregated use alone, or other purposes in the event permanent integration with the bag is not desired.

It is a further object of the present invention to allow single-piece construction of the mat from a wide variety of manufacturing methods, materials, colors, surface textures and fenestrations, or lack thereof, known to those skilled in the art with the preferred embodiment employing co-polypropylene, polyethylene, or other materials that produce the same intended result.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention. Consequently, it should be understood that such descriptions are illustrative only and that various modifications obvious to one skilled in the art to which this present invention pertains are within the spirit, scope and conceptualization of the present invention as further described within the appended claims below.

Figure 1:
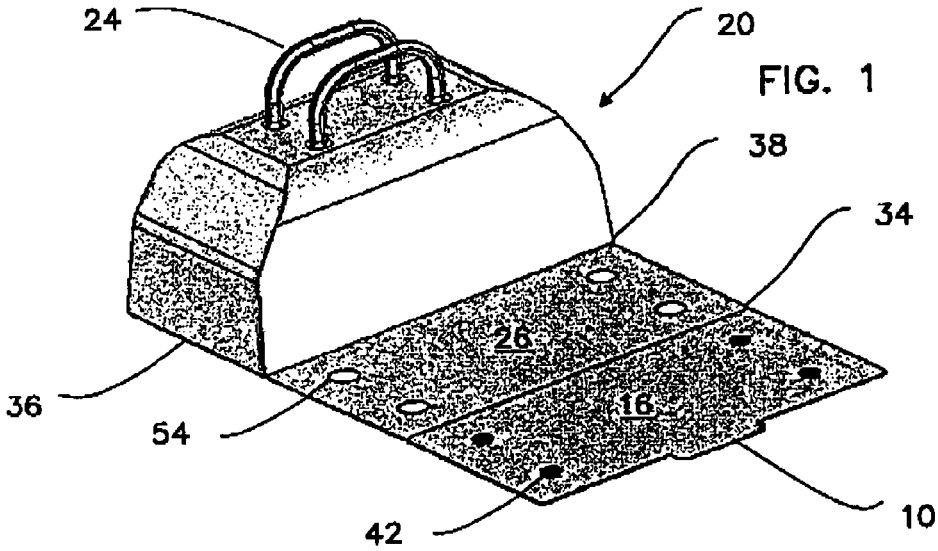
FIG. 1 is a perspective view of the preferred embodiment of the present invention floor shield carrying bag accessory which includes the rigid or semi-rigid hinged panel floor shield mat externally attached to a typical carrying bag in a fully-unfolded and deployed configuration.

Referring to FIG. 1, there is illustrated at 20 a carrying bag to which is affixed a floor shield mat accessory. The floor shield mat consists principally of a multiplicity of rigid or semi-rigid panels 16, 26, and 36, which are connected together by hinges 34 and 38 in the preferred embodiment. The carrying bag consists of an exterior surface to which the upper side of panel 38 (not shown) is affixed with the preferred embodiment being the bottom of the carrying bag 20. For purposes of this description and as referenced in the appended claims, the term "mat" will be used to collectively describe panels 16, 26, and 36 and any components integrated into the panels as described below. Similarly, "carrying bag" is defined as a bag used to carry clothing, sports or other equipment, etc., or any variant bag designs such as a gym bag, duffle bag, rucksack, backpack, suitcase, travel bag, etc., or other containers used to carry items.

The floor shield mat is generally of a rectangular shape having an upper side and lower side with the upper sides of panels 16 and 26 illustrated in FIG. 1. Although dimensional variations are possible, the preferred embodiment employs nominal mat dimensions, exclusive of tab 10 that is accessible outside of these dimensions, which allow containment of the mat within the footprint of the carrying bag as illustrated in FIG. 4 when in a fully stowed configuration.

Figure 2:
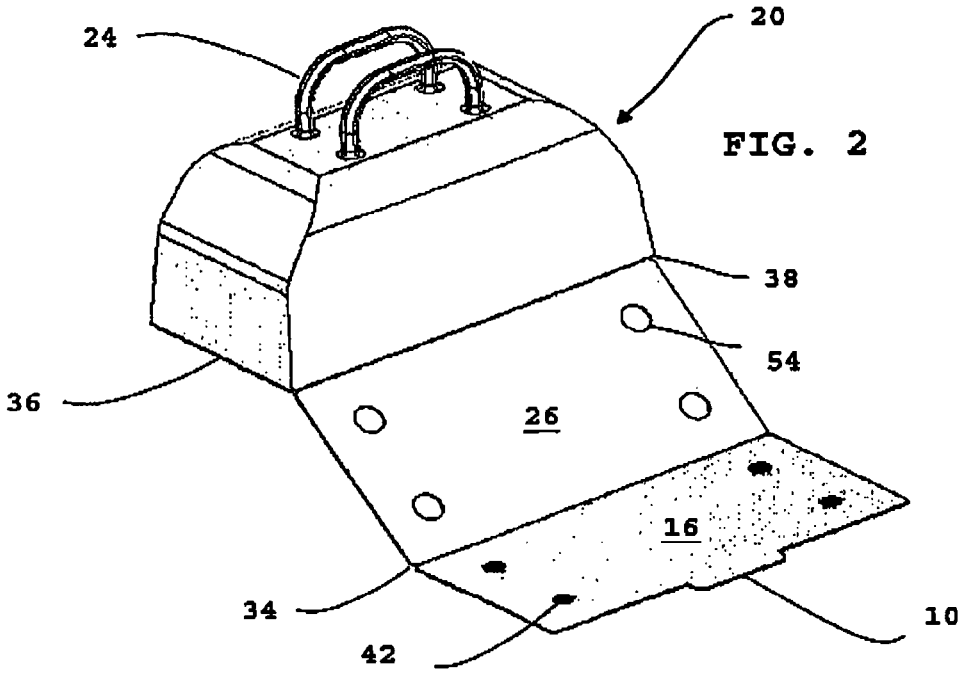
FIG. 2 is a perspective view of the preferred embodiment which includes the rigid or semi-rigid hinged panel floor shield mat externally attached to the bag in a three-quarter partially-deployed configuration.
Figure 3:
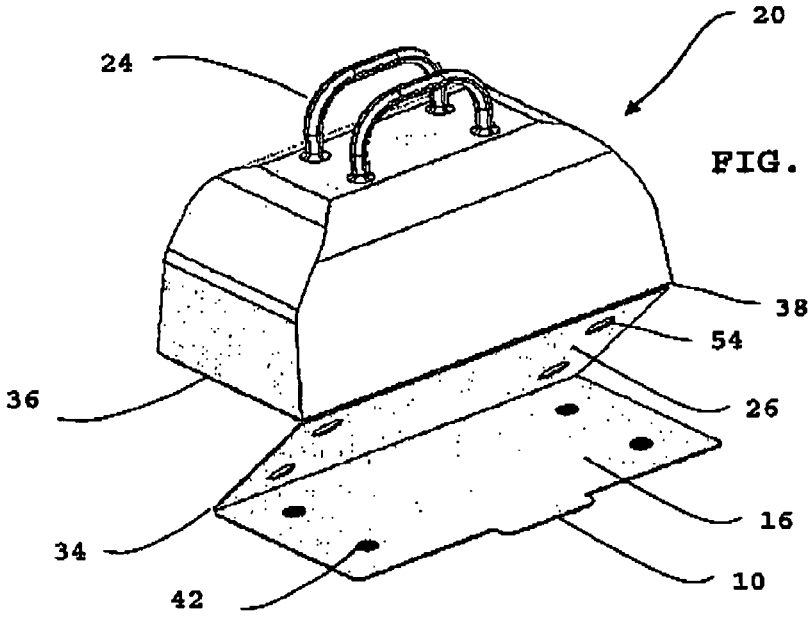
FIG. 3 is a perspective view of the preferred embodiment which includes the rigid or semi-rigid hinged panel floor shield mat externally attached to the bag in a one-quarter partially-deployed configuration.
Figure 4:
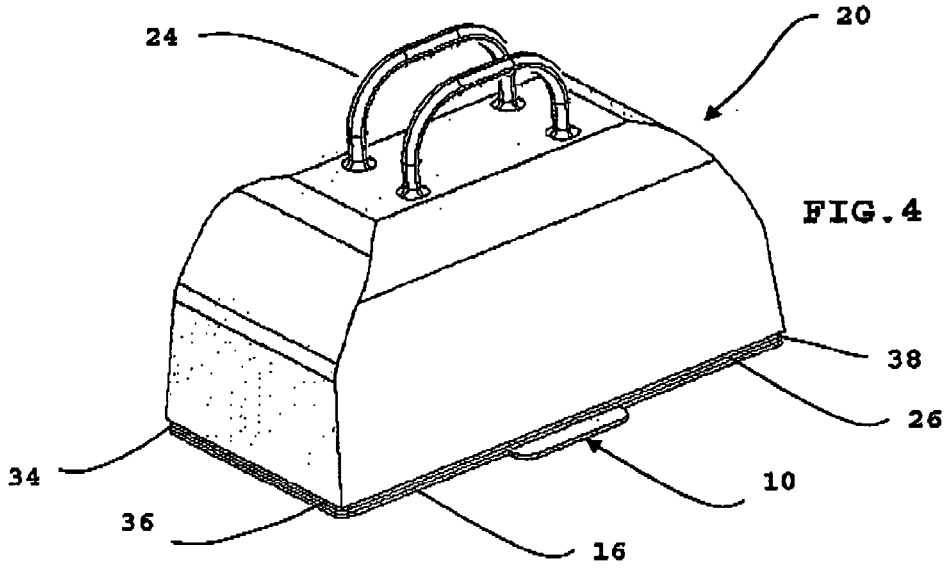
FIG. 4 is a perspective view of the preferred embodiment which includes the rigid or semi-rigid hinged panel floor shield mat externally attached to the bag in a fully-folded and stowed configuration.

FIGS. 1, 2, 3, and 4 illustrate various configurations of the invention during deployment and stowage. An envisioned deployment sequence of the mat is now described. When the user desires to shield himself/herself from a contaminated floor or surface, the carrying bag 20 and attached mat, as shown in FIG. 4 in the stowed configuration, is placed in a convenient location on the floor with tab 10 positioned within close proximity of the user's feet. The user then steps on tab 10 with one foot to effectively trap panel 16 against the floor and then lifts the bag 20 by means of handles 24 until sufficient force is then applied to release the invention's latching mechanism that holds the mat in a folded stowed configuration. The carrying bag is then placed on the floor with the mat in an unfolded and deployed configuration adjacent to the carrying bag. FIGS. 3, 2 and 1, respectively, and sequentially, illustrate the mat deployment process. When the mat is fully deployed as illustrated in FIG. 1, the user is presented a clean, uncontaminated surface comprised of the upper surfaces of panels 16 and 26 upon which to stand and/or upon which the user can place articles. When the user has completed use of the mat, the user reverses the deployment sequence just described by lifting the bag 20 by its handles 24 and refolding the mat to its original folded and stowed configuration allowing the latching mechanism to retain the mat as shown in FIG. 4. It will be appreciated that other methods of deploying the mat, such as using the hands instead of a foot against tab 10, or alternatively, by simply shaking the carrying bag to deploy the mat without the use of tab 10 are possible.

Figure 5:
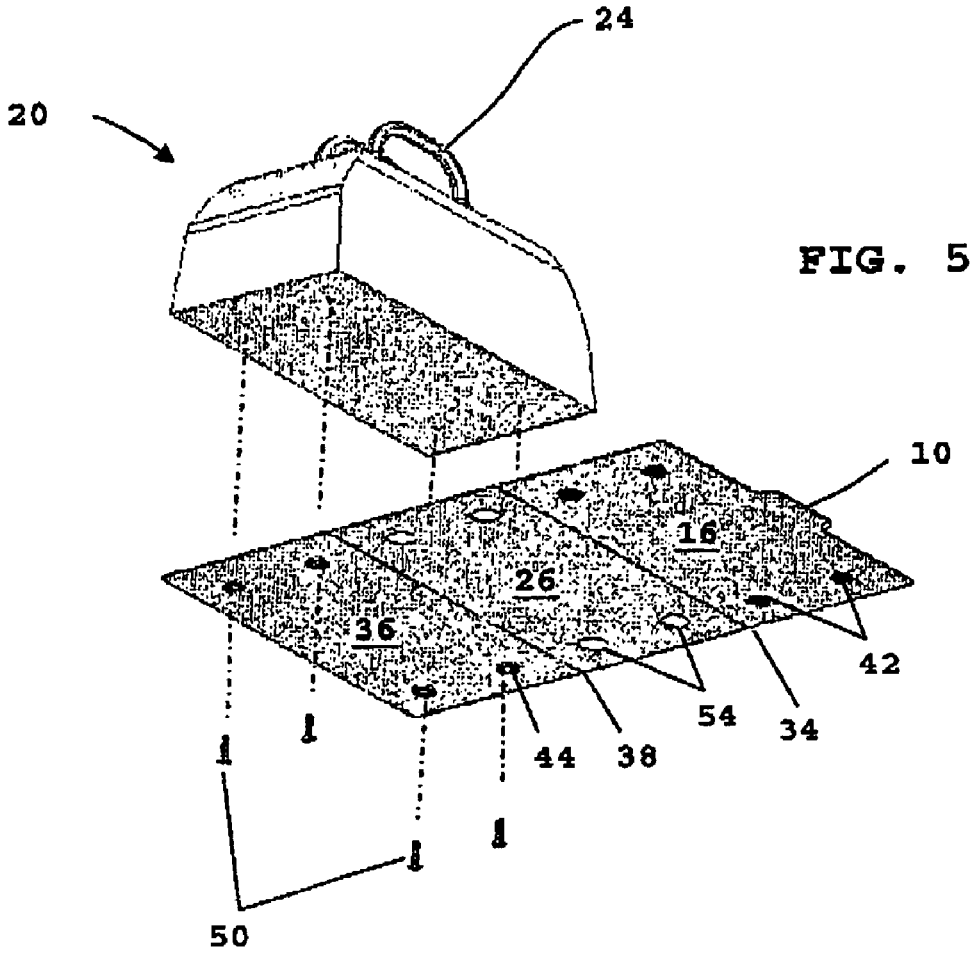
FIG. 5 is an exploded perspective view of the preferred embodiment of the present invention, showing the rigid or semi-rigid hinged panel floor shield externally attached to the bag illustrating one method of removably attaching the floor shield to the bag, as well as arranging and employing magnetic latches to retain the floor shield in a folded configuration.
Figure 6:
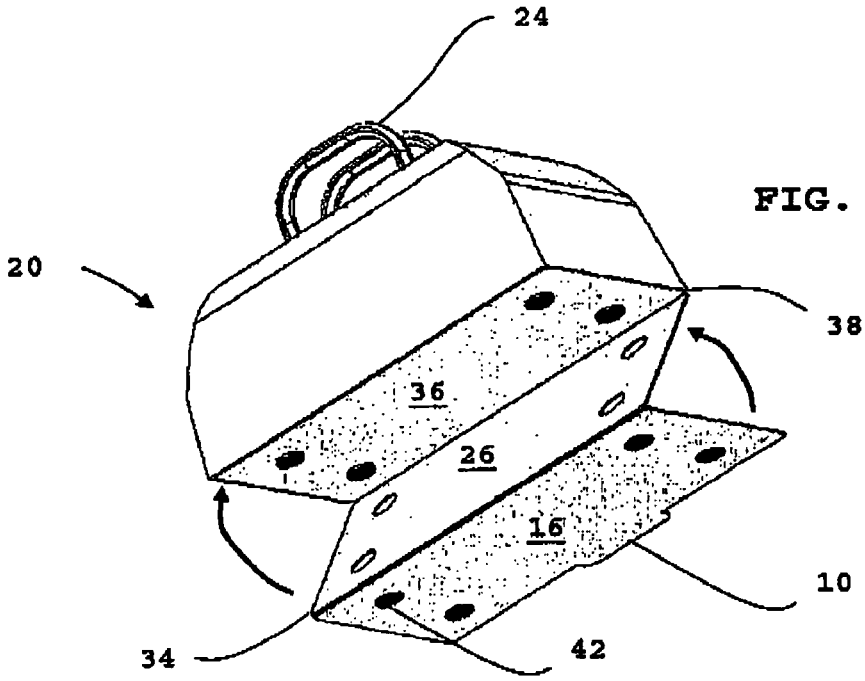
FIG. 6 is a perspective view of the preferred embodiment which includes the rigid or semi-rigid hinged panel floor shield externally attached to the bag illustrating a preferred hinged panel folding scheme.

FIG. 5 illustrates the lower surfaces of mat panels 16, 26, and 36. A preferred option of retaining the mat in a folded configuration is by means of a multiplicity of permanent magnets 44 on panel 36 and mating iron-based armatures 42 on panel 16, as illustrated in FIG. 5. The magnets 44 and mat panel 36 preferably are permanently affixed to the exterior and bottom surface of carrying bag 20 by means of mechanical fasteners, such as rivets or screw-type fasteners. The armatures 42 are mechanically attached to panel 16 and provide surfaces upon which the magnets 44 may attract. As illustrated in FIGS. 5 and 6, when the mat panel 16 come within close proximity to panel 36, the magnets 44 attract their mating armatures 42 and pull the said panels together to retain them in a folded configuration. The folding scheme allowed by hinges 34 and 38 provides repeated alignment of the magnets with their respective armatures through each opening and closing cycle. Although magnetic attraction of the magnets for their armatures can be allowed to occur indirectly through selected mat materials, matching holes 54 may optionally be introduced into panel 26, as shown in FIG. 5, to allow direct contact of magnets 44 with armatures 42 in the stowed configuration. It will be appreciated that any number of latches and alternative configurations of magnet, armature, panel arrangements could conceivably be used and that other methods of retaining said mat in a stowed configuration, such as mechanical latches, hook and loop fasteners, snaps, etc., may be alternatively employed and are within the scope of the present invention. Additionally, other permanent methods of affixing mat panel 36 and magnets 44 to the carrying bag 20, such as with adhesives, sewing, and/or other fastening and/or bonding methods may be employed by anyone skilled in the art.

FIG. 5 illustrates the lower surfaces of mat panels 16, 26, and 36, which are exposed and come into contact with a contaminated floor or surface. FIG. 6 illustrates the mat employing a reverse panel-hinging panel-folding scheme used to preserve uncontaminated surfaces to the user. It should be noted that the uncontaminated upper surfaces of mat panels 16 and 26 shown in FIG. 1 are isolated from a contaminated floor and lower mat surfaces by a reverse-hinging arrangement allowed by hinges 34 and 38. Following the described mat deployment procedure, this mat-folding scheme effectively protects the user by isolating and preventing the contaminated lower mat surfaces from coming in contact with the uncontaminated upper mat surfaces or user.

An alternative embodiment of this invention allows the use of non-permanent, removable methods to those familiar in the art, such as magnetic fasteners or latches, mechanical screw-type fasteners, hook and loop fasteners, snaps, etc., to affix the mat to the carrying bag 20, as shown in FIG. 5, where mechanical screw-type fasteners 50 are illustrated as one example of a means to allow easy mat removal for cleaning, solitary use independent of the carrying bag, or other purposes. In the preferred but optional embodiment, the fasteners or latches are permanently integrated into the mat by any of the mechanical means described above to provide an easily removable, single-component, mat assembly.

A further alternative embodiment of this invention allows the use of the mat and latching method as a stand-alone device, separate from a sport bag. Features such as providing hand hole(s) in the mat to provide a convenient point(s) to grasp the mat are within the scope of this invention.

Although a wide variety of materials and manufacturing methods may be used to fabricate this invention, a preferred embodiment depicts the mat as manufactured as a single-piece from a plastic, such as polypropylene, using injection molding and/or sheet die-cutting and hinge-coining processes. It will also be appreciated that a wide variety of materials having a broad range of features such as surface textures, fenestrations, grooves, colors, biocidal and/or water repellent characteristics, material thickness, shapes, hardness, rigidities, and variety of configurations employing different numbers of panels and hinges may be beneficially integrated into this invention and are within the spirit and scope of the present invention.

Defined broadly, the present invention is a sanitary floor shield mat accessory comprising: a) a rigid or semi-rigid, hinged mat that may be affixed either permanently or removably to the exterior surface of a carrying bag so that the mat may be extended to lay flat adjacent to the carrying bag; b) whereby the mat may be conveniently folded into a compact stowed configuration when not in use and unfolded and extended when in use; c) whereby magnetic or other mechanical methods of retention are used to maintain said mat in a folded configuration when not in use; d) whereby a tabbed feature on the mat allows the user to easily deploy the mat in an extended configuration using a foot and/or hands; e) whereby a mat panel hinging scheme is used to prevent cross-contamination of sanitary surfaces by contaminated surfaces; and f) whereby said invention may be independently used separately from the carrying bag.

Having shown and described a preferred embodiment of the invention, those skilled in the art will realize that many variations and modifications may be made to affect the described invention and still be within the scope of the claimed invention. Thus, many of the elements indicated above may be altered or replaced by different elements, which will provide the same result and fall within the spirit of the claimed invention. It is the intention, therefore, to limit the invention only as indicated by the scope of the claims.

What is claimed is:

1. A carrying bag for placement on a floor by a user, comprising:

a bottom external surface; and a mat attached to said bottom external surface and comprising panels of an at least semi-rigid nature, the panels adapted to provide an unfolded configuration having an upper surface for the user to stand on or to place articles upon and an opposing lower surface to contact the floor; and retainers for holding the mat in a retained folded configuration below the bottom external surface, wherein said mat comprises three panels, the first panel being attached to said bottom external surface, and the second panel being hingedly attached along side edges to the first panel and to the third panel, said upper surface portions of the second and third panels are in inwardly facing relationship to each other when said mat is in the folded configuration so as to prevent cross-contamination of said upper surface with a soiled opposing lower surface.

2. The carrying bag of claim 1, wherein said mat is removably attached to the bag.

3. The carrying bag of claim 1, wherein the panels are integrally formed.

4. The carrying bag of claim 1, wherein the retainers for holding the mat in the folded configuration comprise magnets.

5. The carrying bag of claim 1, wherein said mat is fixedly attached to said bag such that a first panel of said mat serves as the bottom of said bag and the lower surface of the first panel is the bottom external when said mat is in the unfolded configuration.

6. The carrying bag of claim 1, wherein said mat further comprises a tab portion on a side edge of one panel, said tab portion adapted to be grabbed or stepped on.

7. The carrying bag according to claim 1, wherein the panels are stacked on top of each other in the folded configuration and are in adjacent planar relationship on the floor in the unfolded configuration.

8. The carrying bag of claim 1, wherein the panels comprise biocidal materials.

9. A sanitary mat for placement on a floor by a user, in combination with a bag having a bottom portion, comprising:

a plurality of panels of an at least semi-rigid nature, the panels adapted to provide an unfolded configuration having an upper surface adjacent to said bag for the user to stand on or to place articles upon and an opposing lower surface to contact the floor; and a magnetic means of retaining said panels in a folded configuration, wherein one of said panels is adapted to be fixedly or removably attached to the bottom portion of said bag in both the unfolded configuration and in a folded configuration.

10. The sanitary mat according to claim 9, wherein:

the plurality of panels consists of three panels, the first panel being adapted to be attached to the bottom portion of the bag, and the second panel being hingedly attached along side edges to the first panel and to the third panel, wherein the upper surface portions of the second and third panels are in inwardly facing relationship to each other when the mat is in the folded configuration.

11. The sanitary mat according to claim 9, further comprising a tab portion on a side edge of one panel, said tab portion adapted to be grabbed or stepped on.

12. The sanitary mat according to claim 9, wherein the panels are stacked on top of each other in the folded configuration and are in adjacent planar relationship on the floor in the unfolded configuration.

13. The carrying bag of claim 9, wherein said mat is fixedly attached to said bag such that a first panel of said mat serves as the bottom of said bag and the lower surface of the first panel is the bottom external surface when said mat is an unfolded configuration.

14. The carrying bag of claim 9, wherein the panels are integrally formed.

15. A carrying bag for placement on a floor by a user, comprising:

a bottom external surface;

a mat with removable or fixed means of attachment to said bottom external surface with said mat comprising panels being at least semi-rigid in nature, the panels adapted to provide an unfolded configuration having an upper surface upon which a user may stand or place articles and an opposing lower surface to contact the floor; and a magnetic means for retaining said panels in a folded configuration.

16. The carrying bag of claim 15, wherein said mat comprises three panels, the first panel being attached to said bottom external surface, and the second panel being hingedly attached along side edges to said first panel and to the third panel, wherein the upper surface portions of said second and third panels are in inwardly facing relationship to each other when said mat is in the folded configuration.

17. The carrying bag of claim 15, wherein said mat further comprises a tab portion on a side edge of one panel, said tab portion adapted to be grabbed or stepped on.

18. The carrying bag of claim 15, wherein said mat is fixedly attached to said bag such that a first panel of said mat serves as the bottom of said bag and the lower surface of the first panel is the bottom external surface when said mat is an unfolded configuration.

19. The carrying bag according to claim 15, wherein the panels are stacked on top of each other in the folded configuration and are in adjacent planar relationship on the floor in the unfolded configuration.

20. The carrying bag of claim 15, wherein the panels are integrally formed.

* * * * *

UNITED STATES PATENT AND TRADEMARK OFFICE

CERTIFICATE OF CORRECTION

PATENT NO. : 7,222,705 B1
APPLICATION NO. : 10/809228
DATED : May 29, 2007
INVENTOR(S) : Guza It is certified that error appears in the above-identified patent and that said Letters Patent is hereby corrected as shown below:

On Title page, in 76, please delete, “5531” and insert --5337--.
In column 1, line 23, please delete “bene” and insert --been --.
In column 4, line 10, please delete “38” and insert --36--.

Signed and Sealed this

Twenty-first Day of August, 2007

JON W. DUDAS
*Director of the United States Patent and Trademark Office*